US010018941B2

(12) United States Patent
Tomita et al.

(10) Patent No.: US 10,018,941 B2
(45) Date of Patent: Jul. 10, 2018

(54) CLEANING DEVICE, AND IMAGE FORMING APPARATUS AND PROCESS UNIT INCORPORATING SAME

(71) Applicants: Daisuke Tomita, Kanagawa (JP); Takeshi Shintani, Kanagawa (JP); Hiroshi Mizusawa, Tokyo (JP); Yasuhiro Maehata, Tokyo (JP); Yasuhito Kuboshima, Tokyo (JP); Yuta Azeyanagi, Kanagawa (JP)

(72) Inventors: Daisuke Tomita, Kanagawa (JP); Takeshi Shintani, Kanagawa (JP); Hiroshi Mizusawa, Tokyo (JP); Yasuhiro Maehata, Tokyo (JP); Yasuhito Kuboshima, Tokyo (JP); Yuta Azeyanagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/460,531

(22) Filed: Mar. 16, 2017

(65) Prior Publication Data

US 2017/0269511 A1 Sep. 21, 2017

(30) Foreign Application Priority Data

Mar. 18, 2016 (JP) ..... 2016-055472

(51) Int. Cl.

| | |
|---|---|
| ***G03G 21/00*** | (2006.01) |
| ***G03G 21/10*** | (2006.01) |
| ***G03G 15/08*** | (2006.01) |

(52) U.S. Cl.

CPC ..... *G03G 15/0889* (2013.01); *G03G 21/0011* (2013.01); *G03G 21/10* (2013.01)

(58) Field of Classification Search

CPC ..... G03G 15/0887; G03G 15/0889; G03G 21/0011; G03G 21/10; G03G 21/105; G03G 21/12; G03G 2221/0005; G03G 2221/1624

(Continued)

(56) References Cited

U.S. PATENT DOCUMENTS 4,982,240 A * 1/1991 Nakano ..... G03G 21/105 399/350
6,055,405 A * 4/2000 Knott ..... G03G 21/105 399/256

(Continued)

FOREIGN PATENT DOCUMENTS

JP 2010-156938 7/2010
JP 2013-113987 6/2013

(Continued)

*Primary Examiner* — Sophia S Chen
(74) *Attorney, Agent, or Firm* — Oblon, McClelland, Maier & Neustadt, L.L.P.

(57) ABSTRACT

A cleaning device includes a cleaning blade disposed in contact with a rotator, a toner collecting section disposed along the rotator and the cleaning blade and includes a groove extending in an axial direction of the rotator, a conveyor disposed in the groove, and an agitator disposed on a side of a rim of the groove. The conveyor rotates to convey the toner in a longitudinal direction of the groove. The agitator vibrates through contact with the conveyor and includes comb-tooth portions lined in a comb shape in the longitudinal direction of the groove, and bent portions, each of which is bent from an end of one of the comb-tooth portions. The comb-tooth portions contact a circumference of the conveyor to vibrate. The bent portions are lined at intervals smaller than intervals on a base side of the comb-tooth portions.

20 Claims, 9 Drawing Sheets

(58) Field of Classification Search
USPC ..... 399/358, 359, 360
See application file for complete search history.

(56) References Cited

U.S. PATENT DOCUMENTS

| | | | | |
|---|---|---|---|---|
| 6,463,254 | B1 * | 10/2002 | Maul | G03G 21/105 399/350 |
| 8,190,078 | B2 * | 5/2012 | Tawada | G03G 21/105 399/358 |
| 2003/0234262 | A1 * | 12/2003 | Hart | G03G 21/12 222/233 |
| 2009/0257799 | A1 * | 10/2009 | Haruno | G03G 21/12 399/360 |
| 2010/0189461 | A1 | 7/2010 | Shintani et al. | |
| 2012/0134725 | A1 | 5/2012 | Kawahara et al. | |
| 2013/0266344 | A1 * | 10/2013 | Leemhuis | G03G 15/0889 399/256 |
| 2014/0356043 | A1 * | 12/2014 | Tokuda | G03G 21/105 399/358 |
| 2015/0063887 | A1 | 3/2015 | Asaoka et al. | |

FOREIGN PATENT DOCUMENTS

| | | |
|---|---|---|
| JP | 2014-142453 | 8/2014 |
| JP | 2015-045746 | 3/2015 |

* cited by examiner

CLEANING DEVICE, AND IMAGE FORMING APPARATUS AND PROCESS UNIT INCORPORATING SAME

CROSS-REFERENCE TO RELATED APPLICATIONS

This patent application is based on and claims priority pursuant to 35 U.S.C. § 119(a) to Japanese Patent Application No. 2016-055472, filed on Mar. 18, 2016, in the Japan Patent Office, the entire disclosure of which is hereby incorporated by reference herein.

BACKGROUND

Technical Field

Embodiments of the present invention generally relate to an electrophotographic image forming apparatus such as a copier, a printer, a facsimile machine, or a multifunction peripheral (MFP) having at least two of copying, printing, facsimile transmission, plotting, and scanning; and a cleaning device and a process unit used therein.

Description of the Related Art

Electrophotographic image forming apparatuses form an electrostatic latent image on a photoconductor (i.e., an image bearer), develop the latent image, with toner, into a visible image, transfer the image onto a recording medium (e.g., a paper sheet), and fixe the image on the recording medium with heat and pressure. Such image forming apparatuses include a cleaning blade having an end pressed to the photoconductor drum to remove toner from the photoconductor drum after the transferring.

SUMMARY

An embodiment of the present invention provides a cleaning device that includes a cleaning blade disposed in contact with a rotator to remove toner from the rotator, and a toner collecting section disposed along the rotator and the cleaning blade and includes a groove extending in an axial direction of the rotator, a conveyor disposed in the groove, and an agitator disposed on a side of a rim of the groove. The conveyor is to rotate to convey the toner in a longitudinal direction of the groove. The agitator is to vibrate through contact with the conveyor. The agitator includes a plurality of comb-tooth portions lined in a comb shape in the longitudinal direction of the groove, and a plurality of bent portions, each of which is bent from an end of one of the plurality of comb-tooth portions. The plurality of comb-tooth portions is to contact a circumference of the conveyor to vibrate. The plurality of bent portions is lined at intervals smaller than intervals on a base side of the plurality of comb-tooth portions.

In another embodiment, a process unit includes an image bearer as the rotator, on which a toner image is formed; the above-described cleaning device to remove residual toner from the image bearer; and at least one of a toner container, a charging device, and a developing device.

In yet another embodiment, an image forming apparatus includes the above-described process unit and a transfer device to transfer a toner image from the image bearer onto a recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
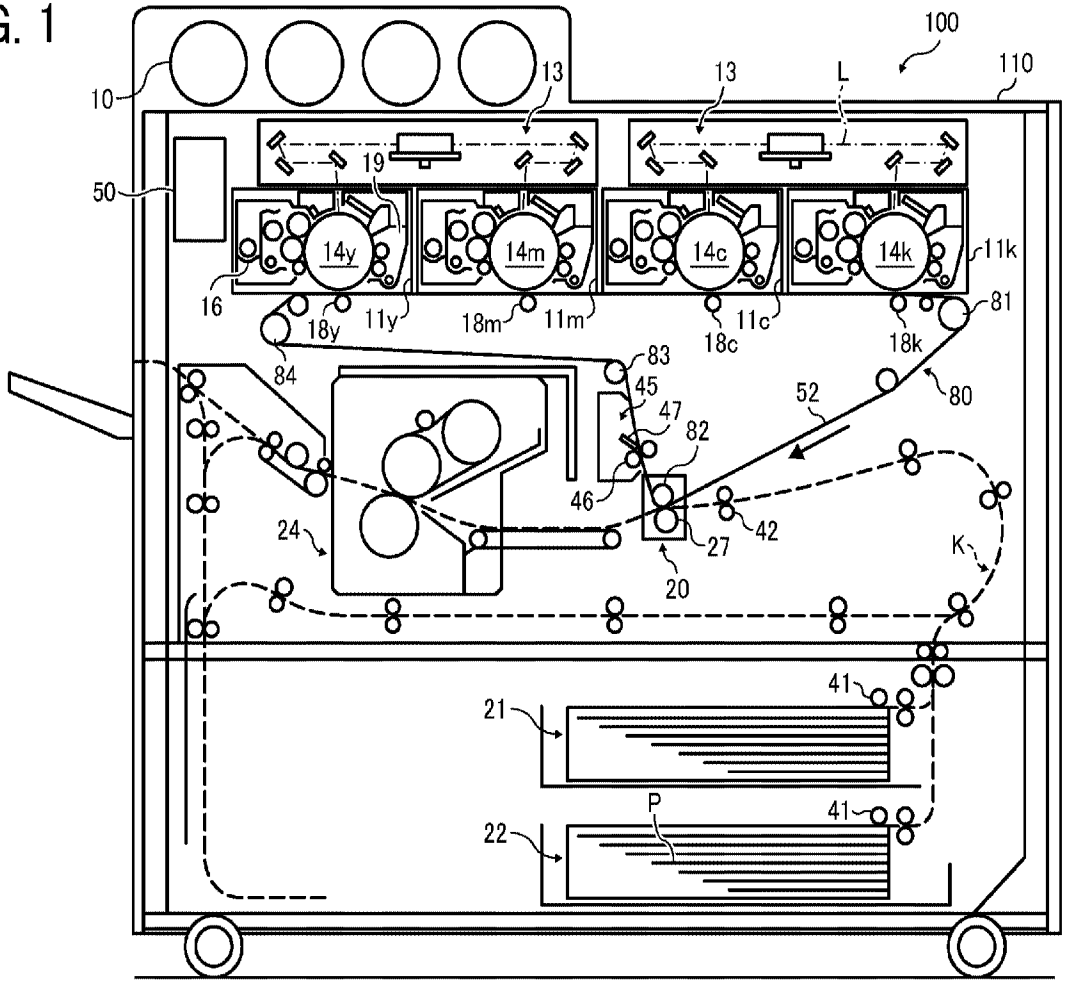
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 10:
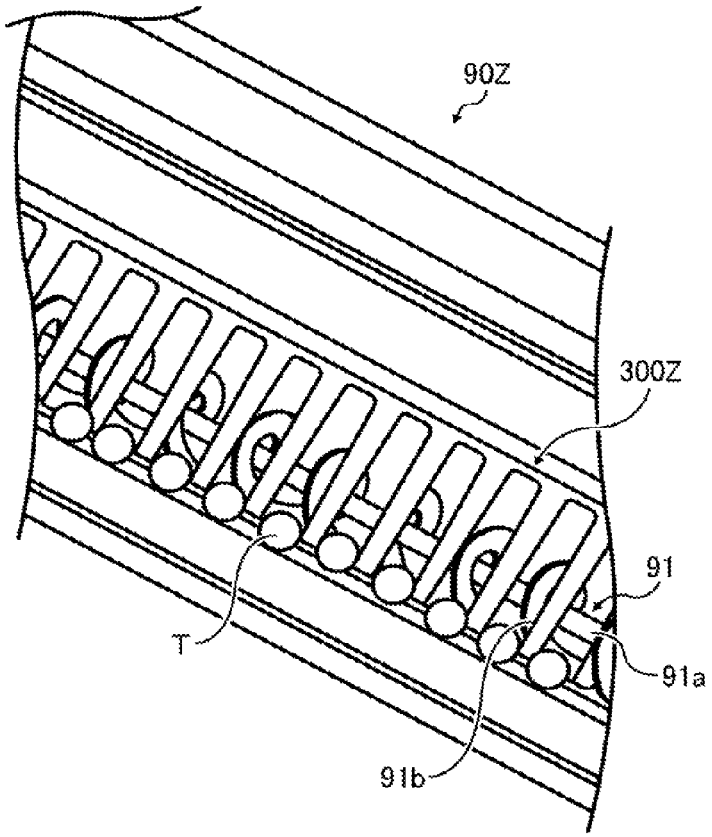
FIG. 10 is a perspective view illustrating a toner bridge in a comparative cleaning device.

FIG. 10 illustrates a portion of a toner collecting section 90Z of a cleaning device according to a comparative example. The toner collecting section 90Z is disposed adjacent to a photoconductor drum. In the configuration illustrated in FIG. 10, a cleaning blade and an entrance seal are disposed on the side of the photoconductor drum, and the toner collecting section 90Z includes a conveying screw 91 disposed on the back (opposite from the photoconductor drum) of the cleaning blade and the entrance seal. A motor is coupled to one end of the conveying screw 91, and the conveying screw 91 conveys the toner collected by the cleaning blade toward the other end thereof.

There are image forming apparatuses in which the photoconductor drum, the developing device, and a toner container are united into a process unit. To make the process unit compact, clearances between components are small, and, in the configuration illustrated in FIG. 10, the clearance between the conveying screw 91 and the cleaning blade is small.

Accordingly, when the amount of collected toner input to the toner collecting section 90Z is greater than the capacity of the conveying screw 91, the upstream side of the conveying screw 91 (in the direction in which the removed toner is conveyed into the toner collecting section 90Z) is likely to be clogged with the collected toner. That is, in FIG. 10, the gaps between the spiral turns of a spiral blade 91*b* of the conveying screw 91 are bridged with toner T (i.e., a toner bridge). Therefore, the toner collecting section 90Z further includes a comb-like agitator 300Z to contact the conveying screw 91 and vibrate as the conveying screw 91 rotates. As tooth at the free end of the agitator 300Z contact the conveying screw 91, the agitator 300Z vibrates to prevent clogging with toner.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

Structure of Image Forming Apparatus

With reference to FIG. 1, an entire structure and operation of an image forming apparatus including a cleaning device according to an embodiment is described. FIG. 1 illustrates an image forming apparatus including a cleaning device according to an embodiment.

An image forming apparatus 100 illustrated in FIG. 1 is, for example, a copier, and includes an intermediate transfer unit 80 located at almost center of an apparatus body 110. The intermediate transfer unit 80 includes an endless intermediate transfer belt 52, serving as an image bearer and an intermediate transfer member, looped taut around a plurality of support rollers.

The plurality of support rollers includes a driving roller 81 to rotate the intermediate transfer belt 52 clockwise in FIG. 1, a secondary-transfer backup roller 82 opposing a secondary transfer roller 27 to be described later, driven rollers 83 and 84, and four primary transfer rollers 18*y*, 18*c*, 18*m*, and 18*k*.

Note that suffixes y, c, m, and k attached to the reference numerals of the primary transfer rollers 18 indicate that components indicated thereby are used for forming yellow, magenta, cyan, and black images, respectively. The suffixes y, c, m, and k may be omitted when color discrimination is not necessary.

The intermediate transfer belt 52 is stretched taut around the support rollers into a shape like an inverse triangle. Above an upper side (the base of the inverse triangle) of the intermediate transfer belt 52, process units 11*y*, 11*c*, 11*m*, and 11*k* (collectively referred to as process units 11), serving as image forming units, are disposed.

The process unit 11*y* includes image forming components for yellow, and a yellow toner image formed thereby is transferred onto the intermediate transfer belt 52. Similarly, the process unit 11*m* serves as the image forming unit for magenta, the process unit 11*c* serves as the image forming unit for cyan, and the process unit 11*k* serves as the image forming unit for black. The toner images are transferred from the process units 11 onto the intermediate transfer belt 52 at primary-transfer positions opposing the primary transfer rollers 18, respectively. As the intermediate transfer belt 52 rotates, the toner image on the intermediate transfer belt 52 is transported to a secondary transfer section 20.

Above the four process units 11*y*, 11*c*, 11*m*, and 11*k* in FIG. 1, a pair of exposure devices 13 (optical writing units) are disposed. The pair of exposure devices 13 irradiates photoconductor drums 14 serving as image bearers (or rotators) with exposure beams L according to image data. The pair of exposure devices 13 receives respective color data based on image data of documents transmitted to a controller 50 from a scanner or the like and drives four semiconductor lasers, via a laser controller, to emit four exposure beams L. The pair of exposure devices 13 scans, with the respective laser beams L, the photoconductor drums 14 (14*y*, 14*c*, 14*m*, and 14*k*) of the process units 11 to form electrostatic latent images for yellow, cyan, magenta, and black on the surfaces of the photoconductor drums 14.

The secondary transfer section 20 transfers the toner image from the intermediate transfer belt 52 onto a recording sheet P serving as a recording medium. The intermediate transfer unit 80 and the secondary transfer section 20 together serve as a transfer device to transfer a toner image from the image bearer onto a recording medium. The image forming apparatus 100 further includes sheet feeders 21 and 22 containing the recording sheets P and a fixing device 24 to fix the toner image on the recording sheet P.

Figure 2:
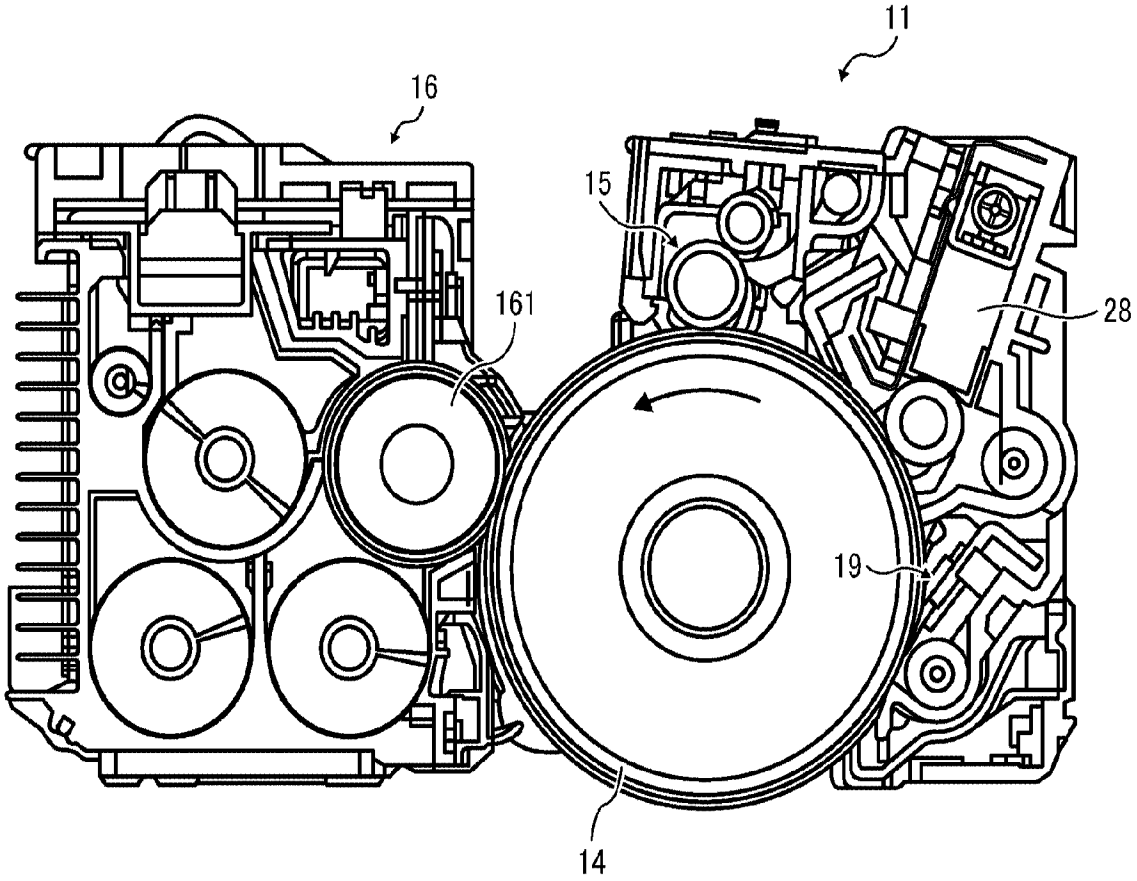
FIG. 2 is a schematic cross-sectional view of a process unit of the image forming apparatus illustrated in FIG. 1.

Referring to FIGS. 1 and 2, descriptions are given below of the process unit 11. In FIG. 1, reference numerals of the image forming components disposed around the photoconductor drum 14 are indicated in the process unit 11*y* but are omitted in the process units 11*c*, 11*m*, and 11*k* for simplicity. FIG. 2 is a cross-sectional view illustrating a structure of the process unit 11 according an embodiment and the periphery thereof.

As illustrated in FIG. 2, the process unit 11 includes, around the photoconductor drum 14, a charging device 15 to charge the photoconductor drum 14, a developing device 16 to develop the latent image on the photoconductor drum 14, a cleaning device 19 to collect untransferred toner from the photoconductor drum 14, and a lubricant applying device 28. In the developing device 16, a developing roller 161 is disposed.

The process units 11 (11*y*, 11*c*, 11*m*, and 11*k*) are similar in structure and operation except the color of toner used therein.

Operation of Process Unit

Image forming operation of the process unit 11 is described below. The controller receives image data from a scanner or the like and decomposes the image data into respective data of the four colors. For example, yellow image data is converted into electric signals and transmitted to the exposure device 13 corresponding to the process unit 11*y*. Then, the exposure device 13 emits, to the photoconductor drum 14, the laser beam L based on the electric signals indicating the yellow mage data.

The photoconductor drum 14 rotates counterclockwise in FIG. 2. The circumferential surface (extending in the direction of arc, simply referred to as "surface") of the photoconductor drum 14 is uniformly charged at the position opposite the charging device 15. When the charged surface of the photoconductor drum 14 reaches a position to be irradiated with the exposure beam L, the electrostatic latent image is formed corresponding to the image data.

Subsequently, the electrostatic latent image on the surface of the photoconductor drum 14 reaches a position opposite the developing device 16, and the developing device 16 develops the latent image into a visible image. The developing device 16 contains developer and includes a stirring roller to stir the toner in developer with carrier, together with toner supplied from a toner container 10. Thus, the toner is electrically charged through friction and carried on the developing roller 161 together with the carrier.

While the toner on the developing roller 161 passes a doctor blade, the toner is regulated into a layer. Subsequently, the toner adheres to the electrostatic latent image on the photoconductor drum 14 at a position opposing the photoconductor drum 14. As the toner in the developing device 16 is consumed, the toner is supplied from the toner container 10 as required. The controller 50 recognizes the consumption of toner (toner concentration) in the developing device 16 according to detection by an optical sensor disposed facing the photoconductor drum 14.

After the developing by the developing device 16, the surface of the photoconductor drum 14 reaches a position opposing the primary transfer roller 18, which primarily transfers the toner image from the photoconductor drum 14 onto the intermediate transfer belt 52.

After the primary transfer process, a certain amount of toner tends to remain on the photoconductor drum 14, untransferred to the intermediate transfer belt 52. After the surface of the photoconductor drum 14 passes by the primary transfer roller 18, a discharge lamp resets electrostatic potentials remaining on the photoconductor drum 14 with irradiation of light. After being discharged, the surface of the photoconductor drum 14 bearing the untransferred toner reaches the cleaning device 19.

As the intermediate transfer belt 52 rotates, the toner image on the intermediate transfer belt 52 is transported to the secondary transfer section 20 illustrated in FIG. 1. The recording sheet P is conveyed to the secondary transfer device 20 as follows. Referring to FIG. 1, the image forming apparatus 100 automatically selects, or a user selects via a control panel, one of the sheet feeders 21 and 22.

For example, the sheet feeder 21 on the upper side is selected. As a sheet feeding roller 41 is driven, the top one of the recording sheets P contained in the sheet feeder 21 is fed to a sheet conveyance passage K. Then, a registration roller pair 42 temporality stops the recording sheet P conveyed through the sheet conveyance passage K. The registration roller pair 42 rotates to transport the recording sheet P to the secondary transfer section 20, timed to coincide with the arrival of toner image on the intermediate transfer belt 52.

After the toner image is transferred onto the recording sheet P in the secondary transfer section 20, the recording sheet P is fed to the fixing device 24. The fixing device 24 applies heat and pressure to the recording sheet P to fix the toner image on the recording sheet P, after which the recording sheet P is ejected from the image forming apparatus 100.

Downstream from the secondary transfer section 20 in the rotation direction thereof, the intermediate transfer belt 52 reaches a belt cleaning unit 45. At a position opposite a guide roller 46 of the belt cleaning unit 45, a scraping blade 47 removes the remaining toner from the intermediate transfer belt 52. The guide roller 46 gives a certain degree of tension to the intermediate transfer belt 52 and facilitates the scraping of the scraping blade 47. The operational life of the scraping blade 47 is shorter than that of the intermediate transfer belt 52, and the scraping blade 47 is replaced as required. Thus, the image forming process is completed.

Although the description above concerns full-color image formation, alternatively, the image forming apparatus 100 is capable of forming single-color images, bicolor images, or three-color images using one, two, or three of the four process units 11.

Cleaning Device

Figure 3A:
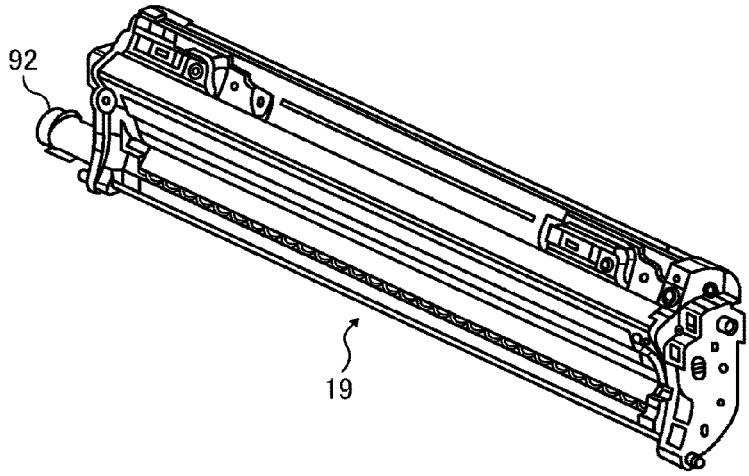
FIG. 3A is a perspective view of a unit including a cleaning device according to an embodiment and a lubrication device.
Figure 3B:
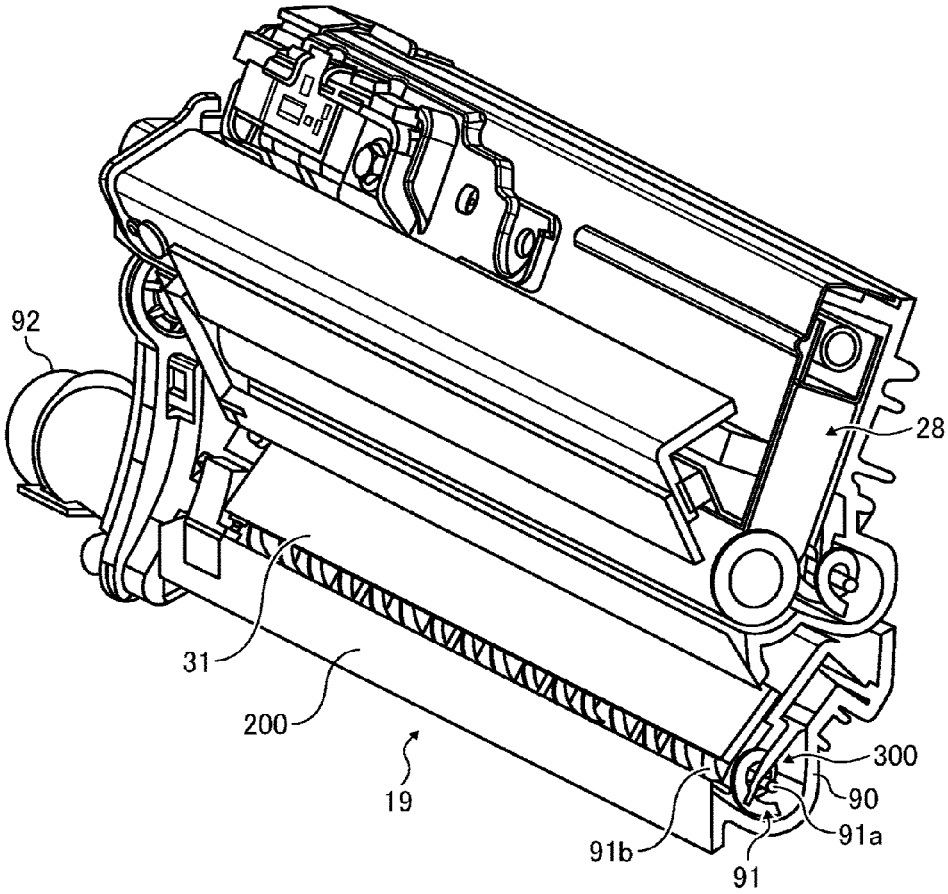
FIG. 3B is an enlarged cross-sectional view of the unit illustrated in FIG. 3A.

The cleaning device 19 is described below. As illustrated in FIG. 3B, the cleaning device 19 includes a cleaning blade 31 and a toner collecting section 90 having a capacity. A casing of the toner collecting section 90 (including a jaw-like portion 93) defines a groove 90*a* (i.e., a toner conveyance channel) extending in the axial direction of the photoconductor drum 14. Inside the groove 90*a*, a conveying screw 91 serving as a toner conveyor is disposed to rotate. The conveying screw 91 conveys the toner collected in the groove 90*a* in the longitudinal direction of the groove 90*a*.

For example, the conveying screw 91 is made of stainless steel or the like and includes a rotation shaft 91*a* and a spiral blade 91*b* winding around the rotation shaft 91*a* as illustrated in FIG. 3B. In another embodiment, the conveying screw 91 is formed of the spiral blade 91*b* without the rotation shaft 91*a*. In another embodiment, the conveying screw 91 is a flexible screw made of an elastic body such as a coil, elastomer rubber, or the like. When a certain amount of rotation torque is applied to the flexible screw, the axis of the flexible screw is irregularly bent or deformed to promote inhibition of bridging of toner inside the toner collecting section 90.

An end (on the left in FIG. 3B) of the rotation shaft 91*a* of the conveying screw 91 is rotatably supported on an end wall of the toner collecting section 90 and coupled to a motor 92 outside the end wall. The other end (on the right in FIG. 3B) of the rotation shaft 91*a* of the conveying screw 91 is rotatably supported by a bearing disposed on an end wall of the toner collecting section 90.

The toner collecting section 90 includes the jaw-like portion 93 and an entrance seal 200. The jaw-like portion 93 is disposed upstream from the cleaning blade 31 in the rotation direction of the photoconductor drum 14 and adjacent to the surface of the photoconductor drum 14. The entrance seal 200 is disposed on the jaw-like portion 93 and contacts the surface of the photoconductor drum 14 in a direction trailing to the rotation of the photoconductor drum 14. In a state in which the cleaning device 19 is assembled, an end of the entrance seal 200 is pressed against the photoconductor drum 14 and opposed to the end of the cleaning blade 31.

Figure 4A:
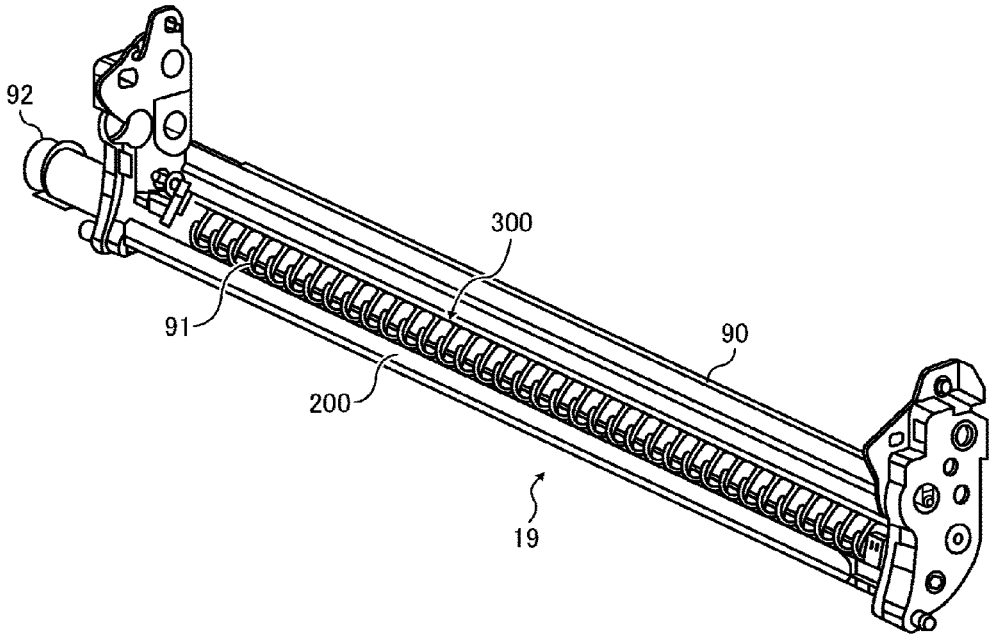
FIG. 4A is a perspective view of the cleaning device illustrated in FIGS. 3A and 3B.
Figure 4B:
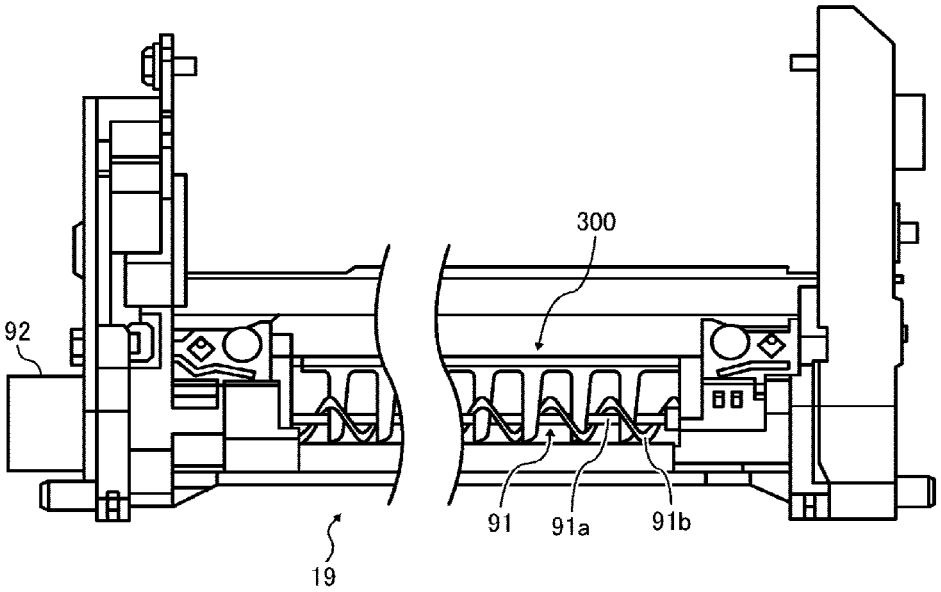
FIG. 4B is a front view of the cleaning device illustrated in FIG. 4A.
Figure 4C:
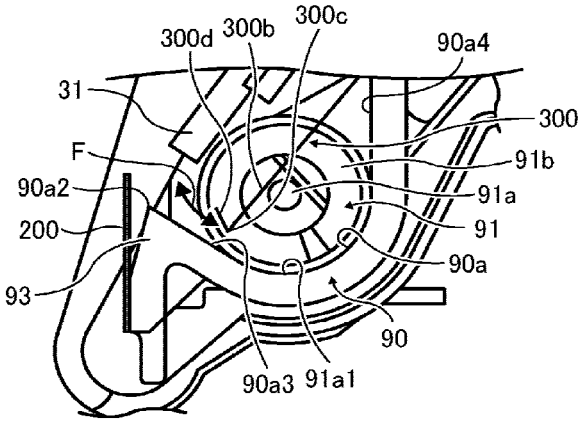
FIG. 4C is a cross-sectional view of a main part of the cleaning device illustrated in FIG. 4A.

With this arrangement, the cleaning blade 31 and the entrance seal 200 together define an inlet to take in the toner as illustrated in FIG. 4C. As the cleaning blade 31 scrapes off the residual toner from the photoconductor drum 14, the toner falls through the inlet into the groove 90*a* of the toner collecting section 90.

As illustrated in FIG. 4C, the groove 90*a* includes a bottom face 90*a*1 shaped in a circular arc and an inclined face 90*a*3 linearly extending from an end (left end in FIG. 4C) of the bottom face 90*a*1 toward a rim 90*a*2 at the end of the jaw-like portion 93. The other end (right end in FIG. 4C) of the bottom face 90*a*1 is continuous with a vertical face 90*a*4 (vertical or almost vertical) disposed on the back side of the cleaning blade 31.

The circumference (i.e., circular in end-on cross section illustrated in FIG. 4C) of the conveying screw 91 is adjacent to the bottom face 90*a*1 or in contact therewith. The toner scraped by the cleaning blade 31 slides down the inclined face 90*a*3 of the toner collecting section 90 under the gravity to the bottom face 90*a*1. As the toner accumulates on the bottom face 90*a*1, the toner is held between spiral turns of the spiral blade 91*b* of the conveying screw 91.

Agitator of Cleaning Device

As illustrated in FIGS. 3B and 4A through 4C, an agitator 300 is disposed on a side of the conveying screw 91 (on the side of the rim 90*a*2 or the photoconductor drum 14). The side on which the agitator 300 is disposed is in front of the conveying screw 91 in FIG. 4B. In the axial direction of the photoconductor drum 14, the length of the agitator 300 is identical or similar to the length of the photoconductor drum 14. The agitator 300 is parallel to the axis of the photoconductor drum 14.

Embodiment 1

In Embodiment 1, the agitator 300 is a comb-shaped sheet, for example, cut out from a sheet capable of elastic bend. Example materials of the sheet include polyethylene terephthalate (PET), polybutylene terephthalate (PBT), polyacetal (POM), and Steel Special Use Stainless (SUS) according to Japan Industrial Standard (JIS).

When used as the agitator 300, PET has an elastic strength particularly effective for inhibiting the toner from forming a bridge. In the case of the agitator 300 made of PET, the PET sheet has a thickness of about 0.125 mm, for example. The thickness is not limited thereto. It is experimentally known that the agitator 300 has an elasticity suitable for effectively breaking toner bridges when the thickness is from 0.1 mm to 0.2 mm.

Figure 5A:
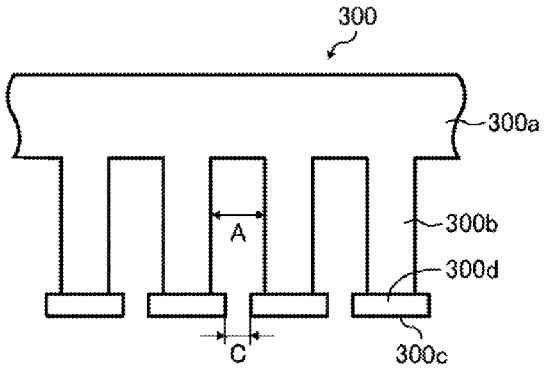
FIG. 5A is a front view of an agitator according to Embodiment 1.
Figure 5B:
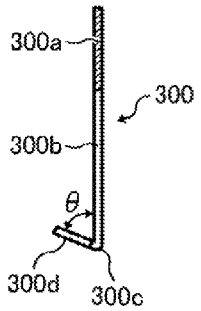
FIG. 5B is a vertical cross-sectional view of the agitator illustrated in FIG. 5A.

An end of the agitator is secured (hereinafter referred to as a base portion 300*a*, illustrated in FIG. 5A) to a casing of the process unit 11 via double-sided adhesive tape, glue, or the like. The agitator 300 includes a plurality of comb-tooth portions 300*b* extending from the base portion 300*a* toward the conveying screw 91. The comb-tooth portions 300*b* are evenly spaced and lined into a comb shape.

In a state in which the conveying screw 91 is disposed in the toner collecting section 90, the circumference of the spiral blade 91*b* elastically contacts the comb-tooth portions 300*b*. Although each comb-tooth portion 300*b* extends perpendicular or almost perpendicular to the axis of the conveying screw 91 in the drawings, the extending direction is not limited thereto.

For example, the strength (i.e., biasing amount) with which the comb-tooth portions 300*b* elastically contact the conveying screw 91 (i.e., the biting amount of the comb-tooth portions 300*b*) is not smaller than 2 mm. The biting amount (e.g., not smaller than 2 mm) is a distance by which a portion of the comb-tooth portions 300*b* closest to the conveying screw 91 approaches to the conveying screw 91 from a state in which the comb-tooth portions 300*b* are disposed in contact with the conveying screw 91 with a pressure of zero. The comb-tooth portions 300*b* having a suitable elasticity and capable of applying the biasing amount is effective to inhibit the bridging of toner.

The portion of each comb-tooth portion 300*b* that sliding contacts the conveying screw 91 is referred to as a sliding contact portion, and the comb-tooth portion 300*b* is bent at the end of the sliding contact portion to form a bent portion 300*d*.

Specifically, the end of each comb-tooth portion 300*b* is bent, preferably at an acute angle θ (i.e., a bend angle), to have a corner 300*c* and the bent portion 300*d*. Then, the bent portion 300*d* faces the inclined face 90*a*3 extending from the end of the bottom face 90*a*1 to the rim 90*a*2 of the groove 90*a*. The angle θ being acute is not essential. The angle θ of the bent portion 300*d* can be greater than 90 degrees as long as the strength of the bent portion 300*d* is maintained, which is described in detail later.

In the axial direction of the conveying screw 91, the bent portions 300*d* are longer (wider) than the comb-tooth portions 300*b*. In this structure, when the gap between the comb-tooth portions 300*b* are, for example, 5 mm or larger, the gap between the bent portions 300*d* can be, for example, 2.5 mm or smaller. Differing the gap distance between the comb-tooth portions 300*b* from the gap distance between the bent portions 300*d* is effective in breaking the toner bridge and discharging the toner.

As the comb-tooth portions 300*b* of the agitator 300 contact the rotating conveying screw 91, the comb-tooth portions 300*b* vibrate. Then, the bent portions 300*d* at the respective ends of the comb-tooth portions 300*b* reciprocate (move back and forth) along the inclined face 90*a*3, drawing a trajectory F as illustrated in FIG. 4C.

The bent portions 300*d* of the agitator 300 are oriented toward the rim 90*a*2 of the groove 90*a*. With this structure, as the bent portions 300*d* reciprocate in the trajectory F illustrated in FIG. 4C, along the inclined face 90*a*3, the bent portions 300*d* efficiently loosen the toner accumulating on the inclined face 90*a*3. Bending the bent portions 300*d* toward the rim 90*a*2 is not essential. The bent portions 300*d* are bent toward the side opposite the rim 90*a*2 in another embodiment as described later.

Action of Agitator

As described above, the agitator 300 vibrates, contacting the conveying screw 91. Specifically, as the conveying screw 91 rotates, the position of contact between the agitator 300 and the conveying screw 91 rises from the rotation shaft 91*a* along the spiral blade 91*b*. As the conveying screw 91 rotates further, the agitator 300 again contacts the rotation shaft 91*a*. Repeating such movement, the agitator 300 vibrates.

As described above, the agitator 300 moves up and down along the spiral blade 91*b* of the conveying screw 91 to vibrate. The agitator 300 draws the trajectory F illustrated in FIG. 4C. The bent portions 300*d* increase the range of the agitator 300 to vibrate. That is, the range capable of breaking the toner bridge is expanded, thereby effectively inhibiting the bridging of toner (clogging).

When the angle θ of the corner 300*c* is acute, the bent portion 300*d* is less likely to sag down by the weight of toner. If the bent portion 300*d* contacts the groove 90*a*, vibration of the comb-tooth portions 300*b* is inhibited.

When the corner 300*c* is inhibited from sagging down, the clearance between the bent portion 300*d* and the groove 90*a* can be maintained. Accordingly, the comb-tooth portion 300*b* is not inhibited from vibrating. The angle θ of the bent portion 300*d* can be greater than 90 degrees as long as the bent portion 300*d* has a necessary strength not to sag down.

The width of the bent portion 300*d* is larger than the width of the comb-tooth portions 300*b* in the present embodiment. When the width of the bent portion 300*d* is identical to the width of the base side of the comb-tooth portions 300*b*, the width of the portion to break the toner bridge (i.e., toner-loosening portion) is small. There is a risk that, in a portion where the comb-tooth portions 300*b* is absent, the toner forms a bridge and falls inside the apparatus.

Increasing the width of the bent portion 300*d* at the end of the comb-tooth portion 300*b* from the width of the comb-tooth portions 300*b* is advantageous as follows. The space for the toner loosed from the toner bridge to reach the spiral blade 91*b* can be secured, and the toner-loosening portion can be large. This structure can inhibit the toner bridge and facilitate the conveyance of toner.

The pitch of the comb-tooth portions 300*b* (arrangement intervals therebetween) can be either identical to or different from the screw pitch of the spiral blade 91*b* of the conveying screw 91. In the case in which the pitches are different, when the pitch of the comb-tooth portions 300*b* is smaller than the pitch of the spiral blade 91*b*, the following advantage is available. Since the adjacent two of the plurality of comb-tooth portions 300*b* vibrate in different directions, the toner can be efficiently removed from the entrance seal 200 and the gaps between the spiral turns of the spiral blade 91*b*. This structure can effectively inhibit the bridging of toner.

As described above, according to an aspect of this disclosure, the agitator 300 includes bent portions 300*d* arranged at arrangement intervals smaller than arrangement intervals of the base side (adjacent to the base portion 300*a*) of the comb-tooth portions 300*b*. This configuration is advantageous in inhibiting clogging with toner or bridging of toner. The possibility of aggregation of toner increases, for example, as the particle diameter of toner decreases to respond to the demand for high-quality images. According to the above-described aspect, such inconveniences are inhibited even when the degree of aggregation of toner is relatively high.

Embodiment 2

Figure 6:
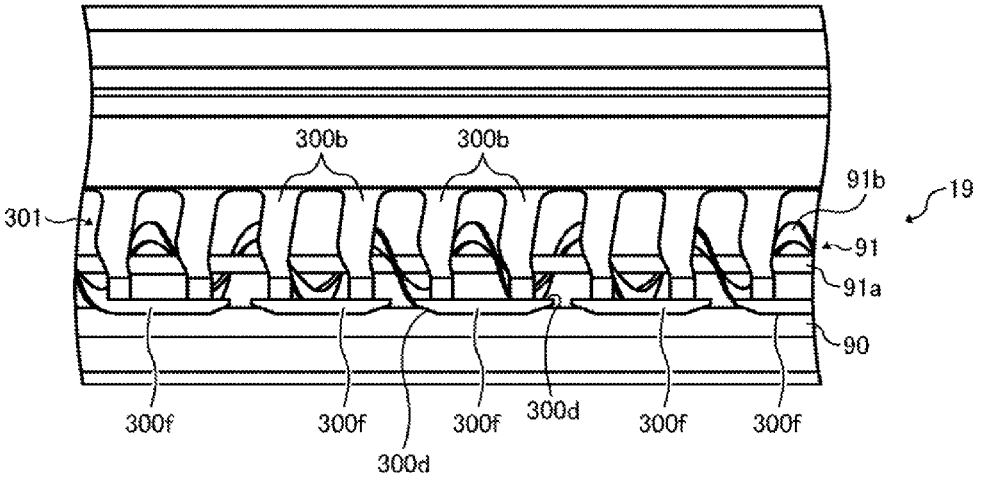
FIG. 6 is an enlarged front view of an agitator according to Embodiment 2.

An agitator 301 according to Embodiment 2 is described below with reference to FIG. 6. In Embodiment 2, the agitator 301 includes a connecter 300*f* to connect the bent portions 300*d* at the end of the agitator 301. Each connecter 300*f* connects adjacent two of the bent portions 300*d*. This structure can reduce the variations in processing and variations in vibration of the agitator 301, thereby effectively inhibiting the bridging of toner. Further, the strength of the agitator 301 increases, and the durability thereof increases. Except that, Embodiment 2 is similar in structure to Embodiment 1.

Embodiment 3

Figure 7B:
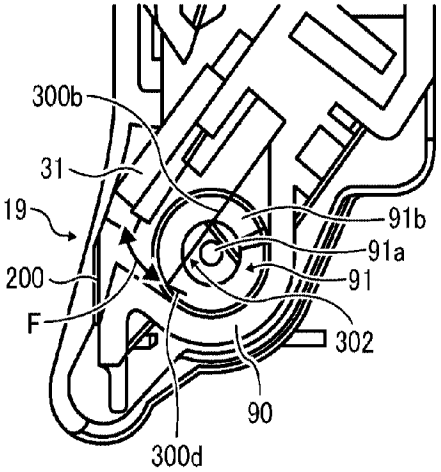
FIG. 7B is an enlarged cross-sectional view of the agitator according to Embodiment 3.
Figure 7A:
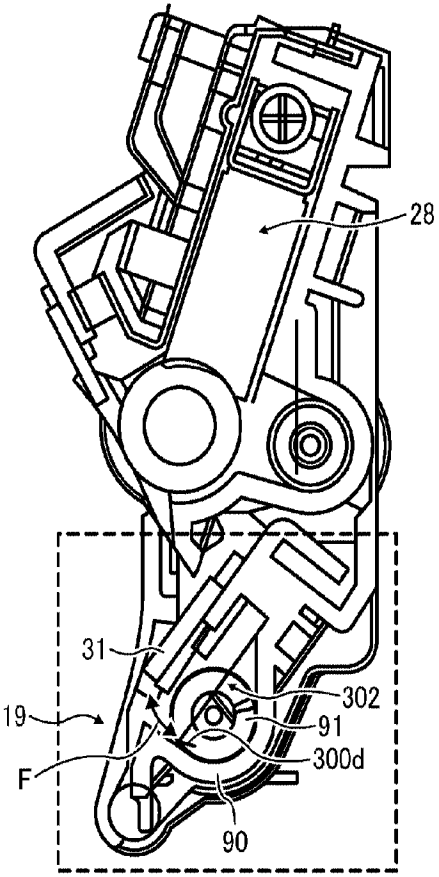
FIG. 7A is a cross-sectional view of an agitator according to Embodiment 3.

An agitator 302 according to Embodiment 3 is described below with reference to FIGS. 7A and 7B. In the agitator 302 according to Embodiment 3, the direction of bending of the bent portions 300*d* is different from that in Embodiments 1 and 2. The bent portions 300*d* are bent to the side opposite the rim 90*a*2. With this structure, while reciprocating in the trajectory F illustrated in FIGS. 7A and 7B, the bent portions 300*d* efficiently loosen the toner accumulating on the inclined face 90*a*3 and between the spiral turns of the spiral blade 91*b*. This structure can effectively inhibit the bridging of toner. Except that, Embodiment 3 is similar in structure to Embodiment 1.

Embodiment 4

Figure 8A:
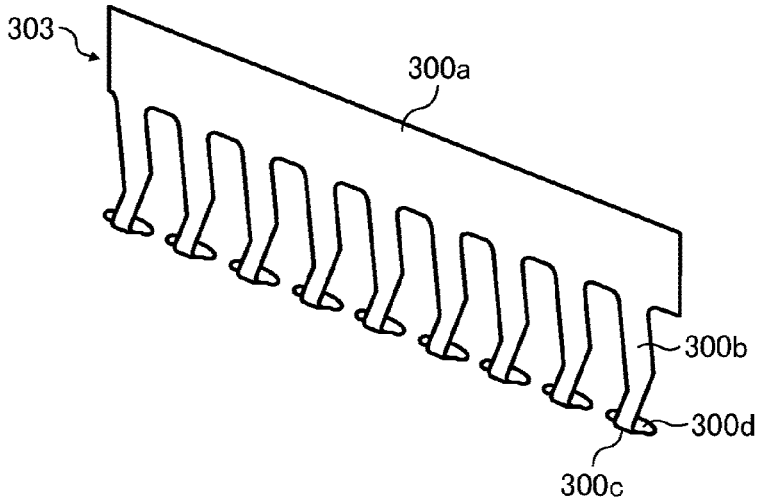
FIG. 8A is a perspective view of an agitator according to Embodiment 4.
Figure 8B:
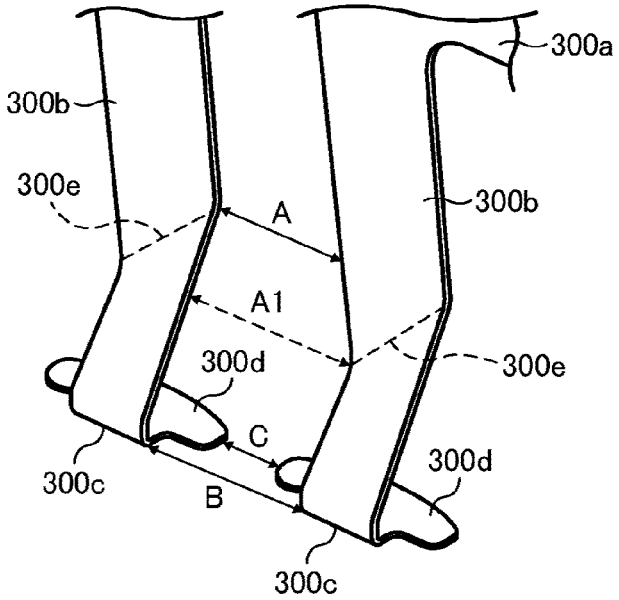
FIG. 8B is an enlarged perspective view of the agitator illustrated in FIG. 8A.

An agitator 303 according to Embodiment 4 is described below with reference to FIGS. 8A and 8B. In Embodiment 4, each comb-tooth portion 300*b* includes a curved portion 300*e* at an intermediate position of the comb-tooth portion 300*b*. The curved portion 300*e* is slant relative to the axis of the conveying screw 91. The bent portions 300*d* are bent (oriented) toward the bottom face 90*a*1, which is the opposite side from the rim 90*a*2. The bend angle of the bent portion 300*d* is greater than a curve angle of the curved portion 300*e*.

Other structures, such as the angle θ at the corner 300*c*, are similar to those of Embodiment 1.

Owing to the curved portion 300*e*, the end portion of the comb-tooth portion 300*b* closer to the free end of the agitator 303 than the curved portion 300*e* backs away to the opposite side of direction to which the bent portion 300*d* is oriented. With the slant curved portion 300*e*, the relative sizes of the arrangement intervals (distance) between the comb-tooth portions 300*b* satisfy the relation defined as $$C<A<A1<B$$

where A represents a base-side arrangement interval, meaning the gap size between base portions of the comb-tooth portions 300*b* closer to the base portion 300*a* than the curved portion 300*e;*

A1 represents an end-side arrangement interval, meaning the gap size between end portions of the comb-tooth portions 300*b* closer to the free end side than the curved portion 300*e;*

B represents a corner-position arrangement interval, meaning the gap size between the corners 300*c* of the comb-tooth portions 300*b*; and C represents a bent-portion arrangement interval, meaning the gap size between the bent portions 300*d*.

This structure can increase the range of the comb-tooth portions 300*b* to vibrate, thereby effectively loosening the toner. Then, the bridging of toner is effectively inhibited. With the relative sizes of the arrangement intervals, while the portions (e.g., the base portion of the comb-tooth portions 300*b*, the end portion of the comb-tooth portions 300*b*, and the bent portions d) of the agitator 303 can have their necessary strengths, the agitator 303 can smoothly discharge the toner toward the conveying screw 91.

Regarding the comb-tooth portions 300*b*, if the base-side arrangement interval A (the gap size in the curved portions 300*e* or base portions closer to the base portion 300*a* than the curved portions 300*e*) is identical to the corner-position arrangement interval B, the toner loosened from the toner bridge is inhibited from being conveyed to the spiral blade 91*b*. The inhibited toner may fall inside the apparatus. By contrast, in the configuration which the gap size is widened (from the base-side arrangement interval A to the corner-position arrangement interval B) in the portion closer to the end side than the curved portion 300*e*, the space is sufficient for conveying the toner toward the spiral blade 91*b*. Accordingly, conveyance and discharge of toner are facilitated.

The bent-portion arrangement interval C being smaller than the corner-position arrangement interval B is advantageous in that the width of the toner-loosening portion to break the toner bridge can be wide, thus preventing the toner from falling. The corner-position arrangement interval B being larger than the base-side arrangement interval A is advantageous in that the toner loosened by the end portion easily move to the spiral blade 91*b*, thus improving the conveyance of toner. The base-side arrangement interval A being smaller than the corner-position arrangement interval B is advantageous in securing the width of the base portion of the comb-tooth portions 300*b* to increase the strength of the base portion.

Compared with the linear comb-tooth portion 300*b*, the comb-tooth portion 300*b* having the curved portion 300*e* can easily reach the bottom (depth) of the toner bridge. Toner bridges can cause overflow of toner, and then the toner can fall into the apparatus. The curved portion 300*e* helps the bent portion 300*d* to reach the depth of the toner bridge to break the toner bridge. In another embodiment, two or more curved portions 300*e* are disposed in a middle portion of the comb-tooth portions 300*b* to further increase the range to vibrate.

Embodiment 5

Figure 9:
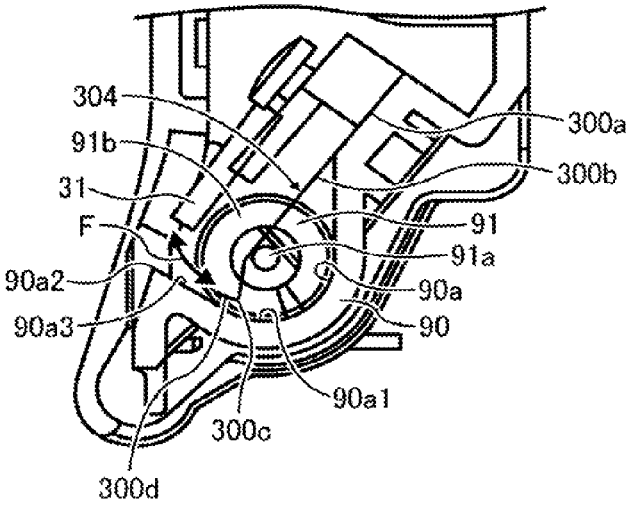
FIG. 9 is a cross-sectional view of an agitator according to Embodiment 5.

An agitator 304 according to Embodiment 5 is described below with reference to FIG. 9. In Embodiment 5, the agitator 304 is similar in shape to the agitator 303 illustrated in FIGS. 8A and 8B, but the bent portions 300*d* are bent toward the rim 90*a*2. This structure can effectively loosen the toner accumulating in a portion extending from the bottom face 90*a*1 to the inclined face 90*a*3, thereby effectively inhibiting the bridging of toner. Other structures, such as the angle θ of the corner 300*c*, are similar to those of Embodiment 1.

One or more of aspects of this disclosure is applicable to removal, conveyance, and loosening of powder not limited to toner.

For example, a power conveyance section or a power stirring section includes a powder channel (a groove) having an opening (i.e., an inlet for powder) extending in the longitudinal direction of the powder channel, a conveyor disposed in the powder channel, and an agitator disposed on a side of a rim of the powder channel. The conveyor is to rotate to convey the powder in a longitudinal direction of the powder channel. The agitator is to vibrate through contact with the conveyor. The agitator includes a plurality of comb-tooth portions lined in a comb shape in the longitudinal direction of the powder channel, and a plurality of bent portions, each of which is bent from an end of one of the plurality of comb-tooth portions. The plurality of comb-tooth portions is to contact a circumference of the conveyor to vibrate. The plurality of bent portions is lined at intervals smaller than intervals on a base side of the plurality of comb-tooth portions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A cleaning device comprising:

a cleaning blade disposed in contact with a rotator, the cleaning blade to remove toner from the rotator, a toner collecting section disposed along the rotator and the cleaning blade, the toner collecting section including a groove extending in an axial direction of the rotator;

a conveyor disposed in the groove, the conveyor to rotate to convey the toner in a longitudinal direction of the groove; and an agitator disposed on a side of a rim of the groove, the agitator to vibrate through contact with the conveyor, the agitator including:

a plurality of comb-tooth portions lined in a comb shape in the longitudinal direction of the groove, the plurality of comb-tooth portions to contact a circumference of the conveyor to vibrate; and a plurality of bent portions, each of which is bent from an end of one of the plurality of comb-tooth portions, the plurality of bent portions lined at arrangement intervals smaller than arrangement intervals on a base side of the plurality of comb-tooth portions, wherein each of the plurality of comb-tooth portions of the agitator includes at least one curved portion, and wherein a bend angle of the plurality of bent portions is greater than a curve angle of the at least one curved portion.

2. The cleaning device according to claim 1, wherein the agitator further includes a connecter connecting adjacent two of the plurality of bent portions.

3. The cleaning device according to claim 1, wherein the conveyor includes a conveying screw, and wherein of the plurality of comb-tooth portions is arranged at intervals not greater than a screw pitch of the conveying screw.

4. The cleaning device according to claim 1, wherein the plurality of comb-tooth portions is arranged at intervals not smaller than 5 mm, and wherein the plurality of bent portions is arranged at intervals not greater than 2.5 mm.

5. A process unit comprising:

an image bearer being the rotator, on which a toner image is formed;

the cleaning device according to claim 1, to remove residual toner from the image bearer; and at least one of a charging device to charge the image bearer, a developing device to form a toner image on the image bearer, and a toner container to contain toner supplied to the developing device.

6. An image forming apparatus comprising:

the process unit according to claim 5; and a transfer device to transfer a toner image from the image bearer onto a recording medium.

7. A cleaning device comprising:

a cleaning blade disposed in contact with a rotator, the cleaning blade to remove toner from the rotator;

a toner collecting section disposed along the rotator and the cleaning blade, the toner collecting section including a groove extending in an axial direction of the rotator;

a conveyor disposed in the groove, the conveyor to rotate to convey the toner in a longitudinal direction of the groove; and an agitator disposed on a side of a rim of the groove, the agitator to vibrate through contact with the conveyor, the agitator including:

a plurality of comb-tooth portions lined in a comb shape in the longitudinal direction of the groove, the plurality of comb-tooth portions to contact a circumference of the conveyor to vibrate; and a plurality of bent portions, each of which is bent from an end of one of the plurality of comb-tooth portions, the plurality of bent portions lined at arrangement intervals smaller than arrangement intervals on a base side of the plurality of comb-tooth portions, wherein the agitator satisfies a relation defined as $C<A<B$, where A represents arrangement intervals on the base side of the plurality of comb-tooth portions, B represents arrangement intervals on an end side of the plurality of comb-tooth portions, and C represents arrangement intervals of the plurality of bent portions.

8. The cleaning device according to claim 7, wherein the agitator further includes a connecter connecting adjacent two of the plurality of bent portions.

9. The cleaning device according to claim 7, wherein the conveyor includes a conveying screw, and wherein of the plurality of comb-tooth portions is arranged at intervals not greater than a screw pitch of the conveying screw.

10. The cleaning device according to claim 7, wherein the plurality of comb-tooth portions is arranged at intervals not smaller than 5 mm, and wherein the plurality of bent portions is arranged at intervals not greater than 2.5 mm.

11. A process unit comprising:

an image bearer being the rotator, on which a toner image is formed;

the cleaning device according to claim 10, to remove residual toner from the image bearer; and at least one of a charging device to charge the image bearer, a developing device to form a toner image on the image bearer, and a toner container to contain toner supplied to the developing device.

12. An image forming apparatus comprising:

the process unit according to claim 11; and a transfer device to transfer a toner image from the image bearer onto a recording medium.

13. A cleaning device comprising:

a cleaning blade disposed in contact with a rotator, the cleaning blade to remove toner from the rotator;

a toner collecting section disposed along the rotator and the cleaning blade, the toner collecting section including a groove extending in an axial direction of the rotator;

a conveyor disposed in the groove, the conveyor to rotate to convey the toner in a longitudinal direction of the groove; and an agitator disposed on a side of a rim of the groove, the agitator to vibrate through contact with the conveyor, the agitator including:

a plurality of comb-tooth portions lined in a comb shape in the longitudinal direction of the groove, the plurality of comb-tooth portions to contact a circumference of the conveyor to vibrate; and a plurality of bent portions, each of which is bent from an end of one of the plurality of comb-tooth portions, the plurality of bent portions lined at arrangement intervals smaller than arrangement intervals on a base side of the plurality of comb-tooth portions, wherein a bend angle of the plurality of bent portions is an acute angle.

14. The cleaning device according to claim 13, wherein the agitator further includes a connecter connecting adjacent two of the plurality of bent portions.

15. The cleaning device according to claim 13, wherein each of the plurality of comb-tooth portions of the agitator includes at least one curved portion.

16. The cleaning device according to claim 13, wherein the agitator satisfies a relation defined as $C<A<B$, where A represents arrangement intervals on the base side of the plurality of comb-tooth portions, B represents arrangement intervals on an end side of the plurality of comb-tooth portions, and C represents arrangement intervals of the plurality of bent portions.

17. The cleaning device according to claim 13, wherein the conveyor includes a conveying screw, and wherein of the plurality of comb-tooth portions is arranged at intervals not greater than a screw pitch of the conveying screw.

18. The cleaning device according to claim 13, wherein the plurality of comb-tooth portions is arranged at intervals not smaller than 5 mm, and wherein the plurality of bent portions is arranged at intervals not greater than 2.5 mm.

19. A process unit comprising:

an image bearer being the rotator, on which a toner image is formed;

the cleaning device according to claim 13, to remove residual toner from the image bearer; and at least one of a charging device to charge the image bearer, a developing device to form a toner image on the image bearer, and a toner container to contain toner supplied to the developing device.

20. An image forming apparatus comprising:

the process unit according to claim 19; and a transfer device to transfer a toner image from the image bearer onto a recording medium.

* * * * *